United States Patent [19]

Yagi et al.

[11] Patent Number: 4,909,762

[45] Date of Patent: Mar. 20, 1990

[54] ELECTRIC CONNECTOR

[75] Inventors: Sakai Yagi; Kazuto Ootaka, both of Shizuoka, Japan

[73] Assignee: Yazaki Corporation, Japan

[21] Appl. No.: 221,906

[22] Filed: Jul. 20, 1988

[30] Foreign Application Priority Data

Jul. 21, 1987 [JP] Japan ..... 62-110669[U]

[51] Int. Cl.[4] ..... H01R 13/52

[52] U.S. Cl. ..... 439/852

[58] Field of Search ..... 439/852, 853

[56] References Cited

U.S. PATENT DOCUMENTS 3,406,376 10/1968 Varren ..... 439/852
4,699,444 10/1987 Isohata ..... 439/852
4,717,356 1/1988 Rahrig et al. ..... 439/852

FOREIGN PATENT DOCUMENTS 2000388 1/1979 United Kingdom ..... 439/852

*Primary Examiner*—Joseph H. McGlynn
*Attorney, Agent, or Firm*—Wigman & Cohen

[57] ABSTRACT

An electric connector comprises a receptacle including a wall portion and an opening portion for receiving a male terminal, and a resilient contact piece opposite the wall portion within the receptacle and supporting the male terminal in cooperation with the wall portion of the receptacle. The wall portion of the receptacle except for the opening portion is expanded on the side of the resilient contact piece. The width of the opening portion is widened in comparison with the internal side of the receptacle.

3 Claims, 5 Drawing Sheets

ELECTRIC CONNECTOR

The present invention relates to an electric connector having an electric contact portion or receptacle having a rectangular shape in cross section and inserted into a male terminal having a tab shape.

BACKGROUND OF THE INVENTION

As shown in FIG. 1, when connectors are connected to each other, a connector housing 20 for housing a female electric connector or male terminal 21 therein is slantingly disposed, or when the female terminal 21 and a male terminal 23 are respectively slantingly disposed within terminal housing chambers 20*a* and 22*a* of connector housings 20 and 22, a tab-shaped end of the male terminal 23 is not inserted into an electric contact portion or receptacle 24 of the female terminal 21 having a rectangular shape in cross section, but contacts an opening end 25 of the electric contact portion 24. Therefore, the male terminal 23 pushes the female terminal 21 out of the terminal housing chamber 20*a*, and the end of the male terminal 23 is bent. A resilient contact piece 26 is formed by bending a tongue piece projecting towards a bottom plate of the opening end 25 on the internal side of the receptacle 24.

To overcome the problems mentioned above, as shown in FIG. 2, an upper wall 24*a* of the other portion of the receptacle 24 except for the opening end 25 thereof is expanded on the side of the resilient contact piece 26 so as to perform a preferable electric contact with the male terminal 23. Further, a guide portion 27 is formed in a position near the opening end 25 to smoothly insert the male terminal 23 into the female terminal by inclining the upper wall 24*a* on the side of the resilient contact piece 26.

By such a structure, the opening end 25 is widened in comparison with the interior of the receptacle 24. Accordingly, even when the connector housing 20 is slightly slanted, or when the female terminal 21 and the male terminals 23 are respectively slightly slanted within the terminal housing chambers 20*a* and 22*a* of the connector housings 20 and 22, an end portion of the male terminal 23 is easily inserted into the female terminal from the opening end 25, and is further inserted into the interior of the receptacle 24 by the guide of the guide portion 27, thereby solving the disadvantages mentioned above. The male terminal 23 is reliably supported by the resilient contact piece 26 and the upper wall 24*a* therebetween, providing a preferable electrical contact.

Conventionally, in order to constitute the receptacle 24, as shown in FIG. 3, an upper face of the upper wall 24*a* is recessed by press working except for a peripheral portion thereof and a portion on the opening end 25 (see Japanese Laid-Open Utility Models Nos. 58-176379 and 52-155988). Otherwise, as shown in FIG. 4, a slit 28 is formed in a corner portion of the upper wall 24*a* along the longitudinal direction thereof, and an upper face of the upper wall 24*a* is similarly recessed by press working (see Japanese Laid-Open Utility Models Nos. 51-94491, 56-28183 and 58-18673).

However, in the former case shown in FIG. 3, the area of a flat portion 24*b* contacting the male terminal 23 is reduced as the width of the receptacle 24 (the terminal width) is narrow as shown in FIG. 5. Namely, the upper wall 24*a* is used for the corner portion and is not used for the flat porton 24*b*. Accordingly, the width A of the receptacle 24 is limited to about 3.0 or 2.8 mm in the structure shown in FIG. 3, and the width B of the receptacle is limited to about 2 mm in the structure shown in FIG. 4 in which the thickness of the plate material is 0.2 to 0.3 mm and the material is made of phosphor bronze, brass, etc., and the flat portion 24*b* cannot be secured and thereby substantially processed when the width of the receptacle 24 is less than 3.0 mm.

In the latter case shown in FIG. 4, the receptacle can be processed even when the receptacle 24 has a width (e.g., about 2 mm) narrower than that of the former receptacle. However, since the slit 28 is formed, the mechanical strength of the connector is reduced and the receptacle 24 is easily damaged by an external force.

SUMMARY OF THE INVENTION

To overcome the problems mentioned above, an object of the present invention is to provide a compact electric connector providing a preferable electric contact with a male terminal and having a strong mechanical strength so as not to be easily damaged by an external force.

With the above object in mind, the present invention resides in an electric connector comprising receptacle means including a wall portion and an opening portion for receiving a male terminal; and a resilient contact piece opposite said wall portion within the receptacle means and supporting the male terminal in cooperation with the wall portion of the receptacle means; the wall portion of the receptacle means except for the opening portion being expanded on the side of the resilient contact piece, the width of the opening portion being widened in comparison with the internal side of the receptacle means.

BRIEF DESCRIPTION OF THE DRAWINGS

The present invention will be more apparent from the following description of the preferred embodiments thereof in conjunction with the accompanying drawings in which.

DETAILED DESCRIPTION OF THE PREFERRED EMBODIMENTS

The preferred embodiments of the present invention will now be described with reference to the accompanying drawings.

Figure 6:
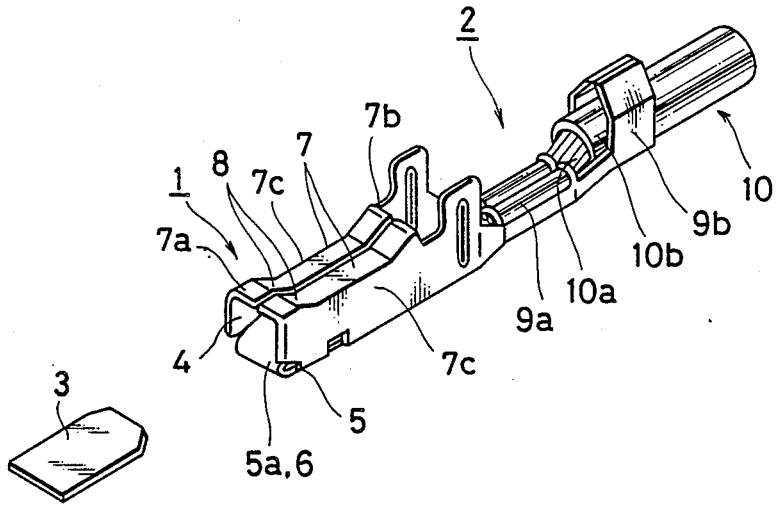
FIG. 6 is a perspective view of an electric connector in accordance with an embodiment of the present invention.
Figure 7:
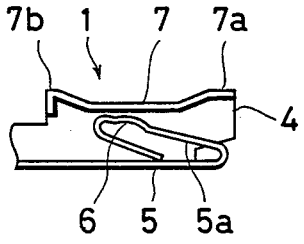
FIG. 7 is a partially cross-sectional view of a receptacle of the electric connector of FIG. 6.

FIG. 6 shows an electric connector in accordance with an embodiment of the present invention. The electric connector has an electric contact portion or receptacle 1 and an electric wire connecting portion 2. The receptacle 1 has a rectangular shape in cross section. A tongue piece 5*a* extends from a bottom plate 5 of an opening end 4 into which a tab-shaped male terminal 3 is inserted, and is bent backwards within the receptacle 1. As shown in FIG. 7, an end portion of the tongue piece 5*a* is further bent to form a resilient contact piece 6.

An upper wall 7 of the receptacle 1 opposite the resilient contact piece 6 is expanded on the side of the resilient contact piece 6 by drawing process except for a portion 7*a* of the upper wall 7 on the opening end 4 and a portion 7*b* thereof on the side of the electric wire connecting portion 2. When the upper wall 7 is expanded by drawing process in the side of the resilient contact piece 6 in this way, no R(curve) portion is formed in a corner portion 7*c* as in the case of press working, and an approximately entire surface of the upper wall 7 drawn in process can be formed as a flat portion contacting the male terminal 3. Therefore, even when the width of the receptacle 1 is narrower and made compact, the flat portion contacting the male terminal 3 can be secured.

Also, since the flat portion of the upper wall 7 contacting the male terminal 3 can be secured, the male terminal 3 can be reliably supported together with the resilient contact piece 6. Further, the mechanical strength of the connector is not reduced since the upper wall 7 is expanded on the side of the resilient contact piece 6 without disposing a slit in the corner portion 7*c*.

The portion 7*a* of the upper wall at the opening end 4 is not drawn in process so that the opening end 4 is widened in comparison with the internal side of the receptacle 1, and the male terminal 3 is easily inserted into the opening end 4. A guide portion 8 is disposed in a position near the opening end 4 of the receptacle 1 and inclines the upper wall 7 on the side of the resilient contact piece 6 so that the male terminal 3 is smoothly inserted into the receptacle 1 from the opening end 4.

The electric wire connecting portion 2 has a press-support piece 9*a* for pressing and supporting an electrically conductive portion 10*a* of an electric wire 10, and a press-support piece 9*b* for pressing and supporting an electrically insulating sheath 10*b*.

Figure 1:
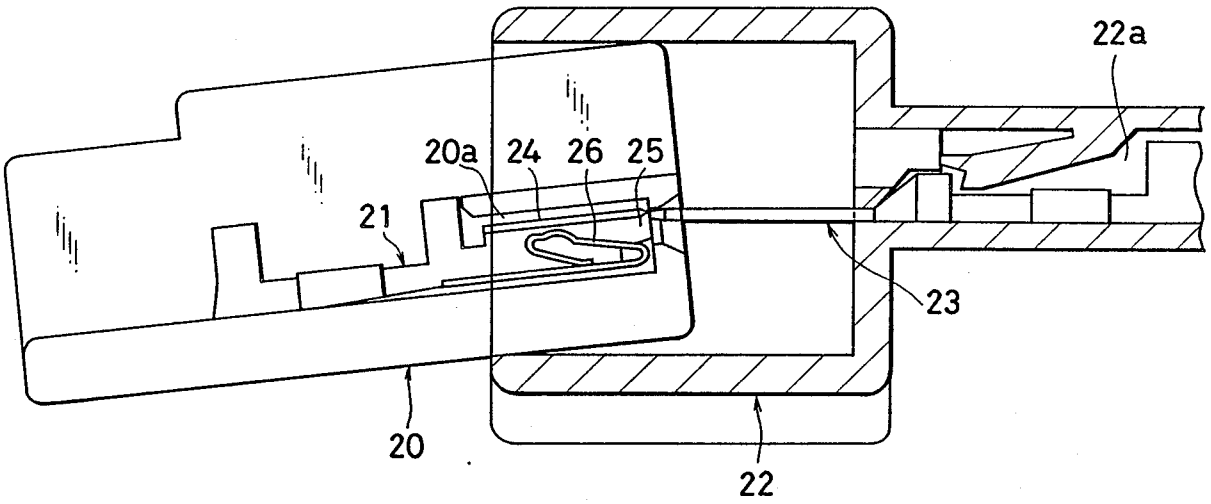
FIG. 1 PRIOR ART
FIG. 1 is a view showing a conventional electric connector when a connector housing is inclined.
Figure 2:
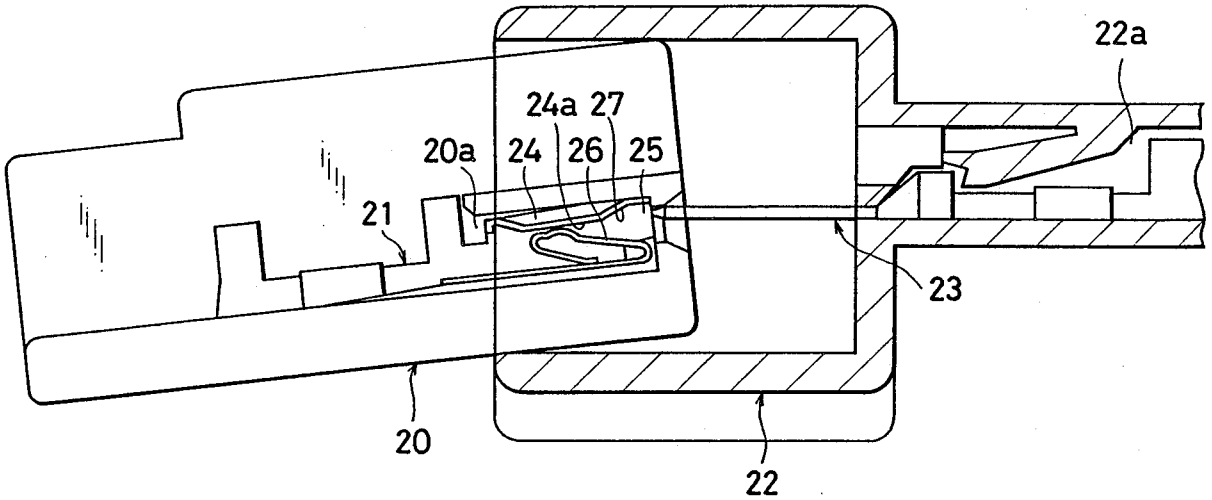
FIG. 2 PRIOR ART
FIG. 2 is a view showing another conventional electric connector for solving the problems related to the connector of FIG. 1.
Figure 3:
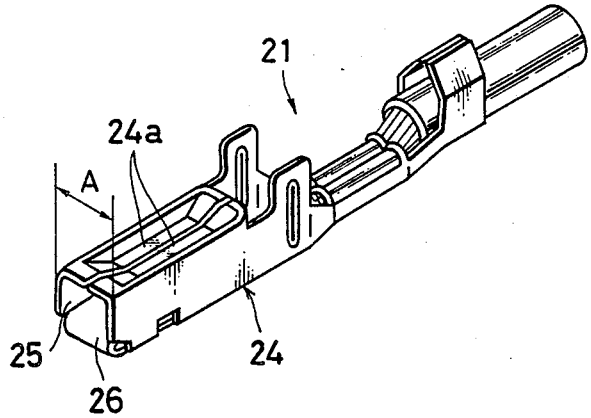
FIG. 3 PRIOR ART
FIGS. 3 and 4 are perspective views of the conventional electric connectors.
Figure 4:
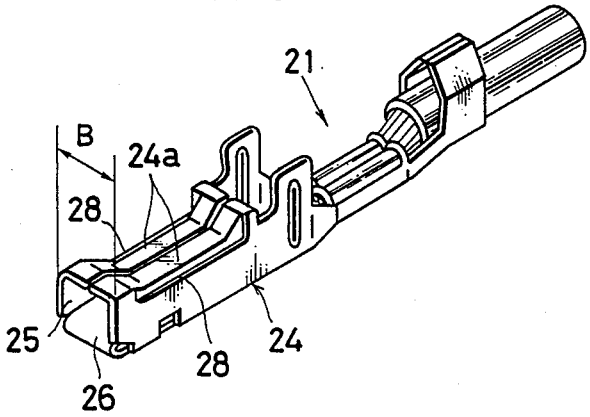
FIG. 4 PRIOR ART
Figure 5:
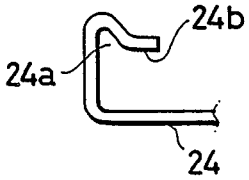
FIG. 5 PRIOR ART
FIG. 5 is a view showing a receptacle of the electric connector shown in FIG. 3.

The electric connector mentioned above constitutes a connector provided within a terminal housing chamber of a connector housing, which is similar to the case shown in FIG. 2. When the electric connector is connected to another connector housing provided with the male terminal 3, even when the connector housing itself is slightly inclined, or even when the electric connector and the male terminal 3 are respectively inclined within the connector housing, an end portion of the male terminal 3 is easily inserted into the receptacle 1 from the opening end 4 by the guide of the guide portion 8. Accordingly, there are no disadvantages that the male connector 3 pushes the electric connector out of the connector housing, or the end portion of the male connector 3 is bent. The male terminal 3 is thus reliably supported by the upper wall 7 and the resilient contact piece 6 therebetween, thereby providing a preferable electrical contact.

Figure 8:
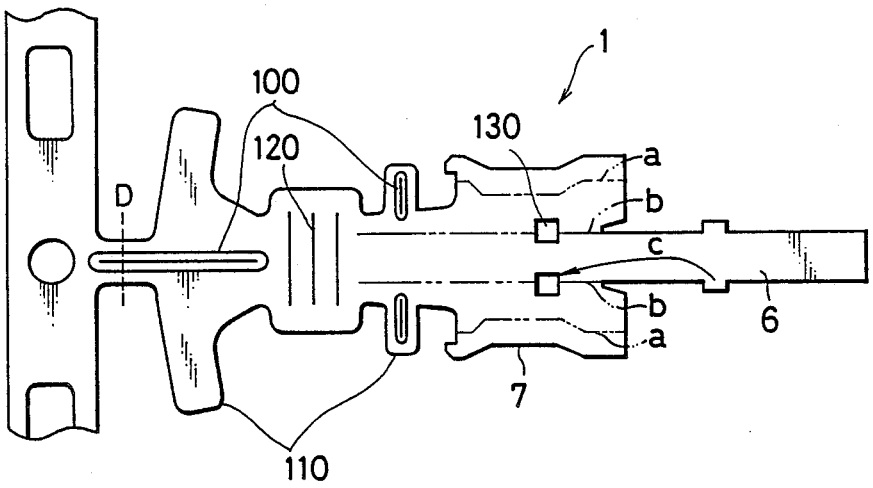
FIG. 8 is a view showing how the electric connector is manufactured.

FIG. 8 shows how the electric connector mentioned above is manufactured in the drawing process. First, a plate material is pressed by pressing work to have an outer shape shown in FIG. 8. The pressed material is next bent by a die along line a, and a portion 6 constituting the resilient contact piece is bent backwards, and the plate material is further bent along line b. Bead portions 100 are disposed to strengthen the electric contact portion 1. Portions 110 constitutes a stabilizer for holding the attitude of the terminal within the housing. Serrations 120 are formed by embossing process using projection to reliably come in contact with a conductor. Projections of the portion 6 are fitted to respective holes 130 formed by punching and shown by arrow C. The electric contact portion 1 thus formed is cut along line D when the connector is used.

As mentioned above, in accordance with the present invention, since the upper wall 7 is expanded by drawing process on the side of the resilient contact piece, a preferable electric contact with a male terminal can be obtained, and the width of the receptacle can be narrower to make the connector compact, and the mechanical strength of the connector is strong so that the connector is not easily damaged by an external force.

What is claimed is:

1. An electric terminal, comprising:

tab receptacle means including a bottom wall portion, two lateral wall portions, an upper wall portion formed by a tip portion of each of the lateral wall portions, and an opening portion defined by the wall portions and into which a male terminal is to be inserted;

contact means provided on the bottom wall portion of the tab receptacle means and resiliently biased toward the upper wall portion of the tab receptacle means so as to support the male terminal in cooperation with the upper wall portion; and a concave portion for ensuring electrical connection between the male terminal and the upper wall portion, the concave portion being formed on the upper wall portion of the tab receptacle means along the entire width thereof, which is perpendicular to the insertion direction of the male terminal, by drawing the tip portion of each of the respective lateral wall portions with respect to the remaining part of the lateral wall portions in such a manner that each of the top portions is bent substantially perpendicularly to the remaining part of the respective lateral wall portions so as to form respective corners therebetween and to make a central portion of the top portions depressed, characterized by the absence of a slit at said respective corners.

2. An electrical terminal as claimed in claim 1, wherein the concave portion has a flat bottom portion extending toward the insertion direction of the male terminal.

3. An electrical terminal as claimed in claim 2, wherein the tab receptacle means has a front portion, the upper wall portion of the tab receptacle means has an inclined surface which forms a part of the concave portion, and the terminal has a guide portion provided on the front of the tab receptacle means for facilitating the insertion of the male terminal, which comprises the inclined surface of the upper wall portion.

* * * * *

UNITED STATES PATENT AND TRADEMARK OFFICE

CERTIFICATE OF CORRECTION

PATENT NO. : 4,909,762

DATED : March 20, 1990

INVENTOR(S) : Sakai Yagi, et al

It is certified that error appears in the above-identified patent and that said Letters Patent is hereby corrected as shown below:

IN THE CLAIMS:

Claim 1, column 4, line 44, "top" should be --tip--;
column 4, line 48, "top" should be --tip--.

Signed and Sealed this

Sixteenth Day of July, 1991

*Attest:*

HARRY F. MANBECK, JR.

*Attesting Officer*

*Commissioner of Patents and Trademarks*